United States Patent [19]

Roland

[11] Patent Number: 4,923,427

[45] Date of Patent: May 8, 1990

[54] SURFING FIGURINE

[76] Inventor: Vincent Roland, 888 Seminole Rd., Atlantic Beach, Fla. 32233

[21] Appl. No.: 290,283

[22] Filed: Dec. 23, 1988

[51] Int. Cl.[5] ..... A63H 23/02; A63H 23/00; A63C 15/00; B63B 3/38

[52] U.S. Cl. ..... 446/153; 446/160; 441/79; 114/140; D11/160; D12/307; D21/130

[58] Field of Search ..... 446/153, 154, 155, 156, 446/157, 158, 159, 160, 74, 163; 441/79; 114/140; D12/301-307, 308; D21/130, 228, 229; D11/160

[56] References Cited

U.S. PATENT DOCUMENTS

| | | | |
|---|---|---|---|
| D. 66,433 | 1/1925 | Strom | D21/130 |
| D. 77,360 | 1/1929 | Jacobs | D12/301 X |
| D. 80,477 | 2/1930 | Brubaker | D21/130 |
| D. 133,078 | 7/1942 | Lee | D12/307 X |
| D. 157,564 | 3/1950 | Byerly | D21/228 |
| D. 168,807 | 2/1951 | Reuther | D21/130 |
| D. 174,948 | 6/1955 | Darr | D21/229 |
| D. 196,947 | 11/1963 | Churchman | D21/228 |
| D. 205,254 | 7/1966 | Levinson | D12/307 |
| D. 207,138 | 3/1967 | Andersen | D12/307 X |
| D. 209,433 | 11/1967 | Bloomingdale | D12/307 |
| D. 276,994 | 1/1985 | Montgomery et al. | D12/307 |
| 658,026 | 9/1900 | Steffens | 446/160 |
| 1,259,572 | 3/1918 | Wilcox | 446/160 X |
| 1,639,707 | 8/1927 | Shaver | 446/160 |
| 1,758,289 | 5/1930 | Loy | 441/74 |
| 1,857,094 | 5/1932 | Doerfler | 446/163 |
| 1,968,710 | 7/1934 | Roehrig | 446/163 |
| 2,525,232 | 10/1950 | McGaughy | 446/160 X |
| 3,203,131 | 8/1965 | Myers | 446/154 X |
| 3,280,501 | 10/1966 | Hornbostel | 446/154 |
| 3,308,577 | 3/1967 | Holt | 446/154 |
| 3,319,276 | 5/1967 | Penney | D21/229 X |
| 3,765,362 | 10/1973 | Gitchel | 446/154 |
| 3,793,761 | 2/1974 | Bonham | 446/154 X |
| 4,020,782 | 5/1977 | Gleason | 441/74 X |
| 4,048,751 | 9/1977 | Muller-Seidel et al. | 446/154 |
| 4,270,307 | 6/1981 | Arigaya | 446/154 |
| 4,538,539 | 9/1985 | Martin | 114/140 |
| 4,541,356 | 9/1985 | Jones et al. | 114/140 X |
| 4,551,113 | 11/1985 | Sugihara | 446/154 |
| 4,708,675 | 11/1987 | Shoeffler et al. | 441/79 X |
| 4,768,988 | 9/1988 | Rutter | 446/163 X |

FOREIGN PATENT DOCUMENTS

| | | | |
|---|---|---|---|
| 0017910 | 10/1980 | European Pat. Off. | 441/79 |
| 0264279 | 4/1988 | European Pat. Off. | 441/79 |
| 1197002 | 7/1965 | Fed. Rep. of Germany . | |
| 2543760 | 4/1977 | Fed. Rep. of Germany | 114/140 |
| 3424548 | 1/1986 | Fed. Rep. of Germany . | |
| 2466389 | 4/1981 | France | 114/140 |
| 2516472 | 5/1983 | France | 441/79 |
| 1451898 | 10/1976 | United Kingdom | 446/325 |
| 2105597 | 3/1983 | United Kingdom . | |
| 2153692 | 8/1985 | United Kingdom . | |

*Primary Examiner*—Robert A. Hafer
*Assistant Examiner*—D. Neal Muir
*Attorney, Agent, or Firm*—Browdy and Neimark

[57] ABSTRACT

A surfing toy is provided in the form of a surfer standing on a surfboard, the two desirably being molded integrally. The device actually surfs, i.e. it stays at the front of a wave even if the wave foams, and rights itself quickly if it is knocked over by a wave. Important features include the provision of a weighted keel which is located below the rear half of the board. The board is desirably much wider than a conventional surfboard relative to its length.

17 Claims, 3 Drawing Sheets

SURFING FIGURINE

FIELD OF INVENTION

The present invention relates to a wave-propelled surfing figurine construction in the nature of a toy or amusement device. This is a CIP of co-pending parent design application Ser. No. Des 112,128 filed Oct. 22, 1987.

BACKGROUND OF THE INVENTION

Various types of boats and surfboards are known. Toy boats are also known. However, there are no previously known toy surfboards actually capable of surfing, because the act of surfing has required the presence of an active and controlling surfer. For example, if a toy boat is placed at a crest of a wave or in front of a wave, usually the wave will merely pass under the boat which will bob like a float; in other words, the wave will not catch the toy boat and propel it forward in the same fashion in which a surfer is able to ride a wave. Until the present time, no one has been able to provide a successful surfing toy which is able to catch a wave and surf towards shore in a manner simulating that of an actual surfer.

The patent literature is replete with patents describing toy boats, and among these is the design patent 168,807 in the name of Reuther which shows a self-propelled double-hulled toy boat with a figurine standing thereon. The Jacobson design patent 77,360 shows an amusement boat with a horse and bicycle thereon. Toy boats having keels are shown in patents including those of Holt 3,308,577; Hornbostel 3,280,501; Sugihara 4,551,113; and Shaver 1,639,707, undoubtedly among others. On the other hand, surfboards do not have keels, although they may have one or more fins at the aft portion, such as illustrated in Levenson D-205,254 and Bloomingdale D-209,433, these latter design patents relating to motorized surfboards, and guiding fins are also shown in Penney U.S. Pat. No. 3,319,276 relating to a water ski construction.

As indicated above, none of the prior devices are able to surf without intervention, i.e. without the activity of a person, and no wave-propelled surfing toy has been previously known to exist.

SUMMARY OF THE INVENTION

It is, accordingly, an object of the invention to overcome deficiencies of the prior art, such as indicated above.

It is another object of the invention to provide amusement and entertainment in the form of a wave-propelled surfing toy.

It is a further object of the invention to provide a wave-propelled surfing figurine construction for simulating a surfer on a surfboard.

It is still another object of the present invention to provide such a wave-propelled surfing figurine construction having a light-weight doll-like figurine portion in a poise simulating a surfer on a surfboard, with a surfboard portion therebeneath and in which the surfboard portion has a heavy-weight keel projecting downwardly primarily from its rear portion.

It is still a further object of the present invention to provide such a wave propelled surfing figurine construction which is integrally molded of plastic and which, with the possible exception of the keel, is hollow.

These and other objects of the invention are achieved by providing such a surfing figurine construction in which the weight of the keel and the effect of gravity acting on said keel causes the surfing figurine construction to fall downwardly in front of the face of a wave and thereby to "surf" in simulation of a human surfer.

The above and other objects and the nature and advantages of the present invention will be more apparent from the following detailed description of certain embodiments taken in conjunction with the drawing, wherein:

DETAILED DESCRIPTION OF EMBODIMENTS

Figure 3:
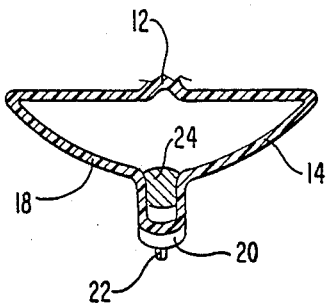
FIG. 3 is a sectional view taken along line 3—3 of FIG. 1.
Figure 2:
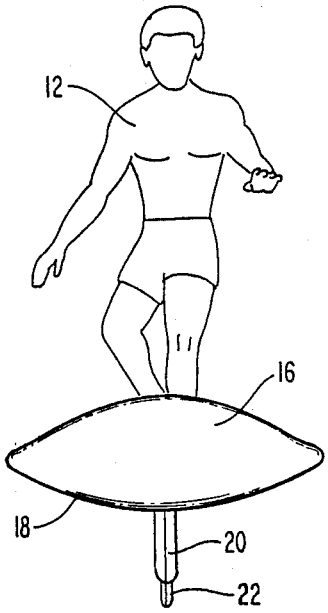
FIG. 2 is a front elevational view of the figurine device of FIG. 1.

A wave-propellable surfing figurine construction 10 according to the present invention as illustrated in FIGS. 1, 2, 4 and 5, and includes a doll like figurine portion 12 and a toy surfboard portion 14. While it is not essential that the figurine portion 12 and the surfboard portion 14 be integrally formed, it is preferred that they be so integrally formed, most desirably of a suitable relatively lightweight plastic and most preferably of hollow construction as shown in FIG. 3, for example, by rotational casting preferably from a vinyl polymer plastisol. The construction 10 must, of course, be sufficiently light to float.

In accordance with a preferred embodiment, the figurine portion 12 is preferably provided in an upright standing poise simulating a balanced surfer on the surfboard portion 14. On the other hand, it will be understood that other poises could be used, including an acrobatic poise wherein the figurine portion is balanced in a hand-stand.

The surfboard portion 14 has a number of characteristics, some of which are relatively important. Thus, the surfboard portion 14 has a front half the front end 16 of which is curved upwardly in typical surfboard fashion. In the illustrated embodiments, the bottom 18 is formed in a general arc shape, i.e. transversely convex, although this configuration is not critical. Very importantly, however, the bottom 18 of the surfboard portion 14 is provided with a heavy-weight keel 20 projecting downwardly primarily from its rear half, such a keel 20 being most untypical of surfboard constructions. Aft of the keel 20 is desirably provided at least one fin stabilizing 22 which also projects downwardly.

As indicated above, the presence of the keel 20 is a most critical element of the surfing figurine construction 10, as proper functioning cannot be achieved without a properly located and relatively heavy-weight keel. Insofar as placement is concerned, the keel is located at least primarily along the rear half of the surfboard portion 14, and it preferably lies entirely at the rear half of the board extending to about 75–78% of the length of the surfboard portion 14 from its nose to its tail.

Insofar as weight is concerned, the keel comprises at least 40% of the total weight of the surfing figurine 10. The heavy-weight keel 20 can be provided in a variety of ways, e.g. it can be molded or formed separately of a heavier material than the remainder of the surfing figurine 10, or it can be co-molded in solid form from a heavier, e.g. metal-filled, plastic while the remainder of the figurine construction is co-molded from a lighter weight plastic. Preferably, however, a relatively heavy ballast element 24 (see FIG. 3), desirably formed of lead or other metal, is pre-fixed within the rotational casting mold by suitable spacer elements and the surfing figurine 10 is then rotationally cast thereabout. In one preferred example, the ballast element 24 constitutes about 43% of the total weight of the surfing figurine 10, although it will be understood that the weight of the keel 20 may generally lie within the ranges of 40–70% of the total weight.

It is also preferred that the keel 20 be weighted along its uppermost portion as illustrated in FIG. 3, rather than having its weight distributed along the entire height thereof. This location facilitates the surfing characteristics of the surfing figurine 10.

Figure 4:
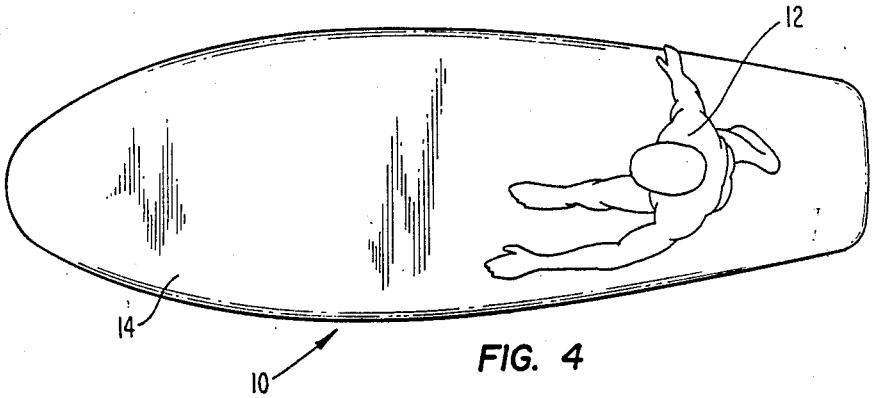
FIG. 4 is a top view thereof.
Figure 5:
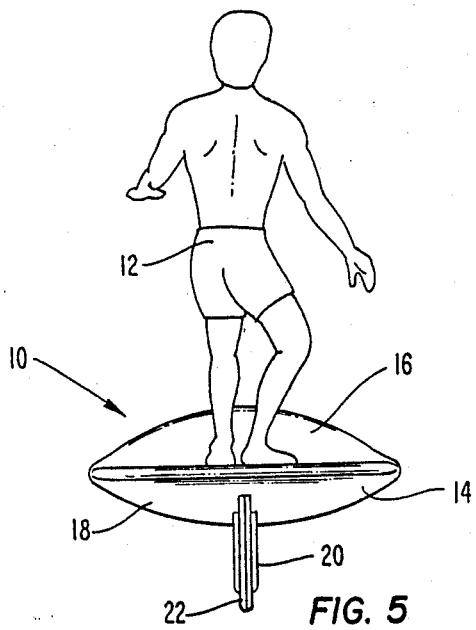
FIG. 5 is a rear elevational view thereof.
Figure 6:
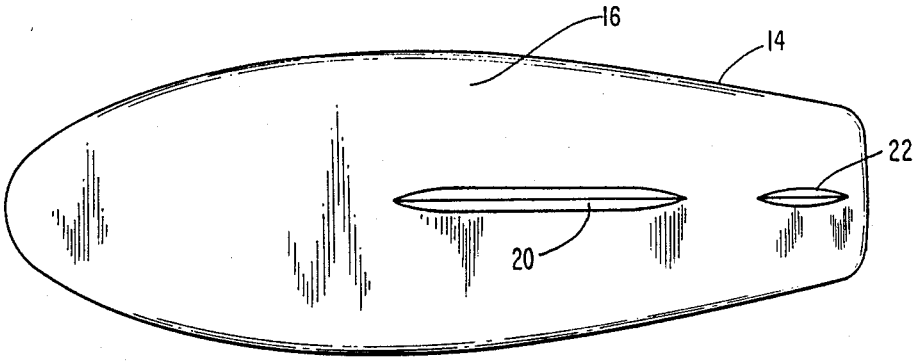
FIG. 6 is a bottom view thereof.

Particularly with reference to FIGS. 4 and 6, it will be seen that the board portion 14 has a very high width to length ratio as compared with a typical surfboard. In practice it has been found that the length of the board portion 14 should in general be no greater than about 3.5 times its width, and a length to width ratio of approximately 3.1:1 has been found particularly suitable. A high width to length ratio gives additional stability to the construction 10 and thereby reduces the incidence of toppling of the device during use. In a preferred embodiment, the light-weight doll-like figurine portion 12 is about 12 inches tall, and the surfboard portion 14 is about 20 inches long and about 7 inches wide at its widest part.

Numerous experimental models have been made. In early models without keels, the construction lacked stability and had a tendency to topple over. Addition of a conventional keel and broadening of the board portion relative to its length solved this problem, but the device would not surf. Further modifications were made including the addition of ballast and moving of the fins, but still the device would not surf. Further models were made in which the keel was moved fore and aft. Finally, a successful construction was achieved when the weighted keel was moved to the rear half of the board portion.

Figure 1:
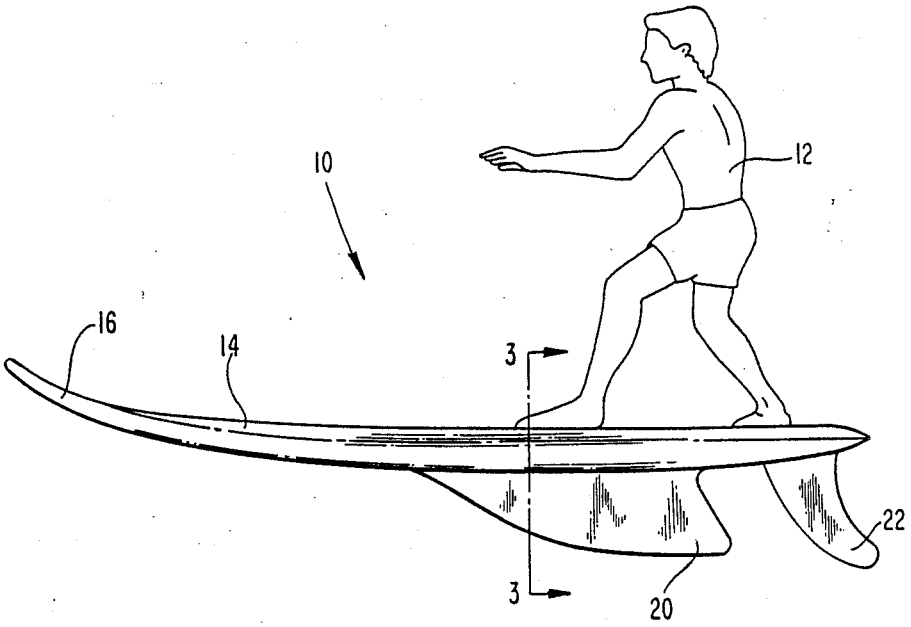
FIG. 1 is a side elevational view of a first embodiment of a surfing figurine construction in accordance with the present invention.
Figure 7:
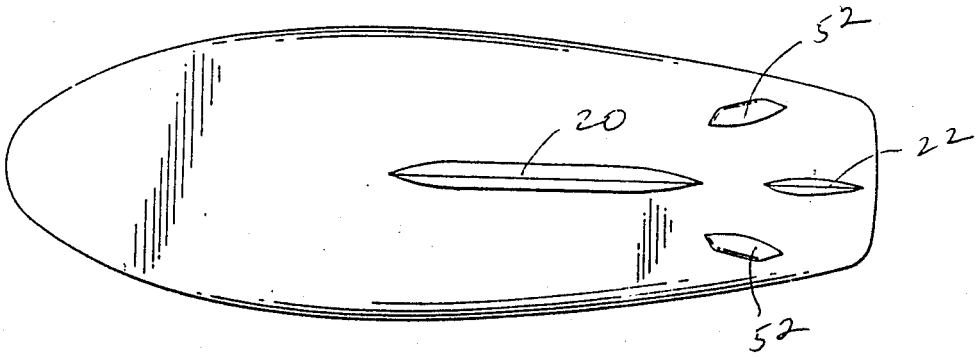
FIGS. 7 and 9 are bottom and rear elevational views, respectively, of a second embodiment.
Figure 8:
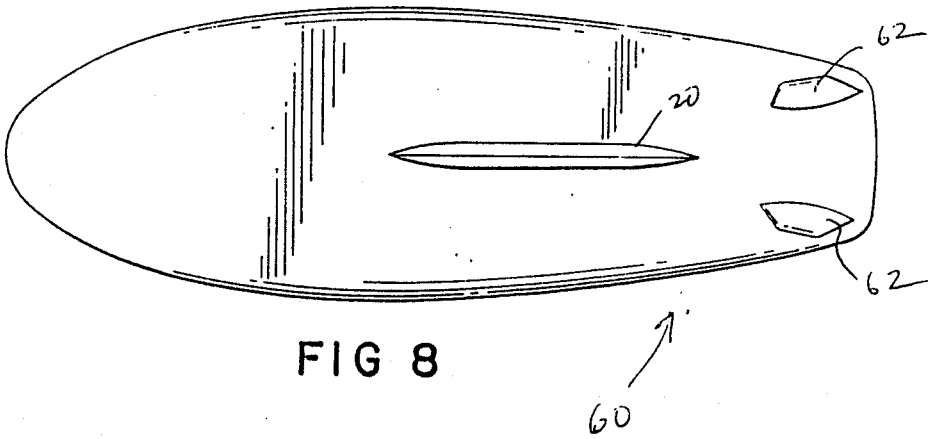
FIGS. 8 and 10 are bottom and rear elevational views, respectively, of a third embodiment according to the present invention.
Figure 9:
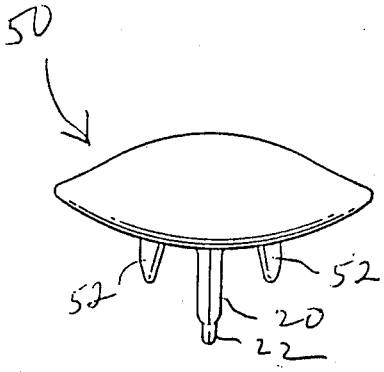
Figure 10:
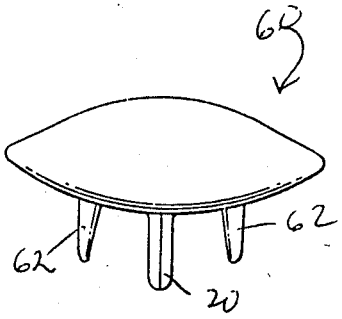

The embodiment 50 of FIGS. 7 and 9 differs from the embodiment 10 of FIG. 1 in the provision of a pair of stabilizing fins 52 in addition to the central stabilizing fin 22. The embodiment 60 of FIGS. 8 and 10 differs from the embodiment 50 of FIGS. 7 and 9 by the elimination of the central stabilizing fin 22 and the provision of a pair of fins 62 aft of the keel 20. It will be noted that the positioning of the fins 62 is not precisely the same as the positioning of the fins 52. In general, one or more fins are important in aiding in forward tracking, although the precise design and precise position of the fins are not critical. Multiple fins provide better stability than a single fin.

Other modifications which are not illustrated are also possible. These will be apparent to those workers of normal skill in the art upon consideration of the present disclosure. It is also possible to provide a power driven version which can be driven, for example, by a propeller or by an internal pump driving water jet. The motors can be battery operated and remote controlled from the shore. Moreover, a turnable rudder can replace the fin 22, and such rudder can also be remotely controlled. In such a powered version, the surfing figurine construction can be placed in the water and driven opposite the direction of the waves to the point where the waves break, and it can then be remotely controlled to turn around whereupon it will surf to shore by wave propulsion. Batteries can be stowed in the keel. Various elements for providing remote controlled constructions will be apparent to those of normal skill in the art, particularly in view of certain prior constructions such as shown in patents to Hornbostel 3,280,501; Bonham 3,793,761; Sugihara 4,551,113; Arigaya 4,270,307; and Muller-Seidel et al 4,048,751.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. A wave-propelled surfing figurine construction for simulating a surfer on a surfboard, comprising:

a light-weight doll-like figurine portion in a poise simulating a surfer on a surfboard; and a toy surfboard portion having a front half with an upwardly curved front end, a rear half, and an upper surface said upper surface being otherwise free at upwardly extending projections supporting said figurine portion, said surfboard portion further comprising a heavy-weight keel projecting downwardly primarily from said rear half, and a stabilizing fin projecting downwardly aft of said keel.

2. A surfing figurine according to claim 1 wherein said figurine portion and said surfboard portion are integrally molded of plastic.

3. A surfing figurine according to claim 1 wherein said surfboard portion, exclusive of said keel, is hollow.

4. A surfing figurine according to claim 4 wherein the weight of said keel comprises at least 40% of the total weight of said surfing figurine.

5. A surfing figurine according to claim 4 wherein said keel comprises 40–70% of said total weight.

6. A surfing figurine according to claim 1 wherein said surfboard portion has a bottom surface which is generally convex transversely.

7. A surfing figurine according to claim 1 wherein said keel is located entirely at said rear half.

8. A surfing figurine according to claim 1 wherein said has an upper half and a lower half, and said upper half is weighted and the lower half is relatively unweighted.

9. A surfing figurine according to claim 1 wherein said surfboard portion has a length no greater than about 3.5 times its width.

10. A surfing figurine according to claim 9 having a length to width ratio of approximately 3.1:1.

11. A wave-propelled surfing figurine construction for simulating a surfer on a surfboard, comprising:

a toy surfboard portion having a front half section with an upwardly curved front end, a rear half section, and an upper surface;

a light-weight doll-like figurine portion projecting upwardly from said surfboard portion and simulating a surfer on a surfboard; and surfing means for enabling said surfing figurine to be reliably propelled forwardly on the crest of a wave in simulation of a surfer, said surfing means comprising a weighted keel which comprises approximately 40% of the total weight of the surfing figurine projecting downwardly from said rear half section of said surfboard portion.

12. A surfing figurine according to claim 11 wherein said figurine portion, said surfboard portion and said keel are integrally molded of plastic, and said figurine portion and said surfboard portion are hollow.

13. A surfing figurine according to claim 11 wherein the weight of said keel comprises at least 40% up to 70% of the total weight of said surfing figurine.

14. A surfing figurine according to claim 13 wherein said keel has an upper half and a lower half, and said upper half is weighted.

15. A surfing figurine according to claim 14 wherein said surfboard portion has a length no greater than about 3.5 times its width.

16. A wave-propellable surfing figurine construction for simulating a surfer on a surfboard, comprising:

a toy surfboard portion having a front half section with an upwardly curved front end, a rear half section and an upper surface;

a hollow light-weight doll-like figurine portion projecting upwardly from said surfboard portion and simulating a surfer on a surfboard; and surfing enhancing means for enabling said surfing figurine to be reliably propelled forwardly on the crest of a wave in simulation of a surfer and for providing balance and longitudinal control and for enabling said surfing figurine to right itself and continue surfing if knocked over by a wave, said surfing enhancing means comprising a weighted keel projecting downwardly primarily from said rear half section of said surfboard portion, said weighted keel comprising at least about 40% of the total weight of said surfing figurine.

17. A wave-propelled surfing figurine construction for simulating a surfer on a surfboard, comprising:

a hollow, light-weight doll-like figurine portion in a poise simulating a surfer on a surfboard integrally molded of plastic, and a toy surfboard portion integrally molded of plastic and having a front half with an upwardly curved front end, a rear half, and an upper surface supporting said figurine portion, said surfboard portion further comprising a heave-weight keel projecting downwardly primarily from said rear half, and a stabilizing fin projecting downwardly aft of said keel.

* * * * *